US011657943B2

(12) United States Patent
Loussert et al.

(10) Patent No.: US 11,657,943 B2
(45) Date of Patent: May 23, 2023

(54) BALLISTIC UNIPOLAR BISTABLE ACTUATOR

(71) Applicant: Moving Magnet Technologies, Besançon (FR)

(72) Inventors: Guillaume Loussert, Moirans (FR); Stéphane Biwersi, Frambouhans (FR)

(73) Assignee: Moving Magnet Technologies, Besançon (FR)

( * ) Notice: Subject to any disclaimer, the term of this patent is extended or adjusted under 35 U.S.C. 154(b) by 0 days.

(21) Appl. No.: 17/285,054

(22) PCT Filed: Oct. 16, 2019

(86) PCT No.: PCT/FR2019/052441
§ 371 (c)(1),
(2) Date: Apr. 13, 2021

(87) PCT Pub. No.: WO2020/084220
PCT Pub. Date: Apr. 30, 2020

(65) Prior Publication Data

US 2022/0005639 A1 Jan. 6, 2022

(30) Foreign Application Priority Data

Oct. 26, 2018 (FR) ..... 1859948

(51) Int. Cl.
*H01F 7/122* (2006.01)
*H01F 1/14* (2006.01)
(Continued)

(52) U.S. Cl.
CPC ..... *H01F 7/122* (2013.01); *H01F 1/14* (2013.01); *H01F 7/14* (2013.01); *H01F 7/1615* (2013.01);
(Continued)

(58) Field of Classification Search
CPC ... H01F 7/122; H01F 1/14; H01F 7/14; H01F 7/1615; H01F 7/1872; H01F 2007/1669; H01F 7/18; H01F 7/1844
See application file for complete search history.

(56) References Cited

U.S. PATENT DOCUMENTS 3,202,886 A * 8/1965 Kramer ..... H01F 7/1615 335/254
4,747,010 A * 5/1988 Bayer ..... H01H 51/2281 335/181
(Continued)

FOREIGN PATENT DOCUMENTS

DE 102010017874 9/2013
DE 102014216274 2/2016
(Continued)

OTHER PUBLICATIONS

International Search Report for International Application No. PCT/FR2019/052441 dated Feb. 5, 2020, 3 pages.
(Continued)

*Primary Examiner* — Bernard Rojas
(74) *Attorney, Agent, or Firm* — TraskBritt

(57) ABSTRACT

An actuator for controlling the movement of an element between two stable positions with pulsed electrical control without a change in polarity comprises: a ferromagnetic mobile mass, at least one electrically controlled wire coil that is fixed with respect to the mobile mass, at least two ferromagnetic poles that are fixed with respect to the mobile mass and on either side of the mobile mass. The actuator comprises at least one permanent magnet that attracts the mobile mass in order to achieve the two stable positions. The mobile mass defines, with the ferromagnetic poles, at least two variable air gaps during the movement of the mobile apparatus. The magnetic flux of the permanent magnet
(Continued)

opposes the magnetic flux generated by the at least one coil regardless of the position of the mobile mass.

11 Claims, 6 Drawing Sheets

(51) Int. Cl.
*H01F 7/14* (2006.01)
*H01F 7/16* (2006.01)
*H01F 7/18* (2006.01)

(52) U.S. Cl.
CPC ... *H01F 7/1872* (2013.01); *H01F 2007/1669* (2013.01); *H01F 2007/1692* (2013.01)

(56) References Cited

U.S. PATENT DOCUMENTS 5,365,210 A * 11/1994 Hines ..... H01F 7/1615 335/229
6,265,956 B1 * 7/2001 Cascolan ..... H01F 7/1615 335/278
2002/0149456 A1 10/2002 Krimmer et al.
2006/0061442 A1 * 3/2006 Brooks ..... H01H 3/222 335/220
2011/0248804 A1 * 10/2011 Wygnanski ..... H01F 7/1646 335/230
2013/0328649 A1 * 12/2013 Robertson ..... H01F 7/1615 335/234
2017/0256348 A1 * 9/2017 Thode ..... H01F 7/1607

FOREIGN PATENT DOCUMENTS

DE 102014113500 3/2016
DE 102009039562 3/2020
EP 0340625 10/1993
EP 1875480 7/2009
FR 2951316 A1 * 4/2011 ..... H01H 51/2272
FR 2951316 1/2013

OTHER PUBLICATIONS

International Written Opinion for International Application No. PCT/FR2019/052441 dated Feb. 5, 2020, 7 pages.

* cited by examiner

BALLISTIC UNIPOLAR BISTABLE ACTUATOR

CROSS-REFERENCE TO RELATED APPLICATIONS

This application is a national phase entry under 35 U.S.C. § 371 of International Patent Application PCT/FR2019/052441, filed Oct. 16, 2019, designating the United States of America and published as International Patent Publication WO 2020/084220 A1 on Apr. 30, 2020, which claims the benefit under Article 8 of the Patent Cooperation Treaty to French Patent Application Serial No. 1859948, filed Oct. 26, 2018.

TECHNICAL FIELD

The present disclosure relates to the field of actuators having two stable positions in the absence of current.

Electromagnetic actuators are generally made in a monostable manner, which is to say, that the magnetic armature of the actuator—when it is not supplied with energy—has a single stable position without current. This stable position is generally determined by the return force of a spring, while the transfer to the other end position on the stroke, called the switched position, is achieved by energizing the magnetic coil or the excitation winding of the electromagnet, according to a so-called "unipolar" power supply, which is to say, that needs only one circulation direction of the electric current. This can be done with rudimentary, economical and easily accessible electronics, in particular, in an automotive electrical network.

In order to keep the magnetic armature in the switched position, the magnetic coil must be continuously supplied with current, without producing any mechanical work. This results in a loss of energy and in heating of the actuator.

To avoid this drawback, it is also well known to use bistable actuator solutions where the magnetic armature always remains in one of the two end positions without energy input, generally using permanent magnets, until it is transferred to the other position by a temporary supply of current to the magnetic coil; it then remains there without the coil being energized. Energy is only needed to transfer the magnetic armature to one of the two end positions, and the energy is largely converted into mechanical work. However, these solutions require a bipolar-type power supply, which is to say, that the direction of the current is different depending on whether one wishes to move from a first stable position to the second stable position or whether one wishes to move from the second stable position to the first stable position. However, this bipolarity of the current requires an electronic architecture that is more complex and expensive than in the unipolar case because it is generally necessary to integrate several switching transistors (according to an assembly typically referred to as an "H-bridge"), and the availability of such architectures may prove problematic in an automotive electrical network, especially when it is necessary to multiply the functions and therefore the availability of this architecture.

BACKGROUND

In the state of the art, European patent EP1875480 is known, which relates to an electromagnetic actuator consisting of a mobile assembly, a fixed ferromagnetic stator assembly comprising at least one electric excitation coil and at least one permanent magnet having two stable equilibrium positions without current at its strokeends. The mobile assembly has two distinct ferromagnetic armatures distributed on either side of the stator assembly and each forming, with the stator assembly, at least one magnetic circuit, and in that the permanent magnet is able to cooperate magnetically with one and the other of the mobile ferromagnetic parts in a stable equilibrium position without holding current at the stroke end. According to a variant, the arrangement of the coils in the electrical phase is carried out in this known solution such that the magnetic flux generated by the first coil comes to be cut off from the flux without current of the first remarkable magnetic circuit while the magnetic flux generated by the second coil is added to the flux without current of the second remarkable magnetic circuit. The actuator can be controlled using bipolar current. The actuator is therefore single-phase and carries a bipolar current.

Such an actuator indeed has two stable positions without current, but requires a reversal of the direction of the control current in order to switch from one position to the other, which implies the use of electronic circuits implementing several power transistors.

Actuators have been proposed that operate with a unipolar power supply and achieve two stable positions, for example, as presented in application US20020149456 or, more recently, application DE102014216274. These documents address, in particular, the general problem of obtaining two stable positions without current consumption, while keeping a simple unipolar power supply and maintaining an electric actuator of the solenoid type accepting any direction of current in its coil but producing only a unidirectional force in each half of the stroke. Therefore, these actuators must be controlled in a ballistic manner, which is to say, by imparting a force that is limited in time and by counting on the kinetic energy transferred to the movable member to reach the opposite stable position.

To achieve the stable positions, these applications propose the use of mechanical elements either in the form of so-called "snap" springs, which is to say, performing a certain positive or negative mechanical work depending on the direction in which they work, or in the form of wedging a ball in a slot, of the "spring plunger" type.

The documents of the prior art solve the general problem of obtaining an actuator with two stable positions without current and actuation controllable with a unipolar current. However, all of these solutions have defects inherent to the very principles of the mechanical systems used to generate these stable positions or to systems requiring a power supply whose polarity is invertible.

Indeed, a first drawback lies in the difficult assembly of the actuators, and, in particular, the difficult indexing necessary between the solenoid-type actuator on the one hand and the mechanical stability members (springs and/or balls) on the other hand. If short strokes are considered, typically, a few tenths of a millimeter to a few millimeters, an indexing error between the movable member and the mechanical stability members implies an asymmetry for the actuator that can prevent ballistic functionality. If an embodiment is imagined in industrial production, incorporating manufacturing tolerances, the costs necessary to ensure these fine tolerances can prove to be prohibitive and minimize the advantage of using such actuators.

In addition, although the solutions of the prior art exhibit a certain compactness, they still have the drawback of separating the functions without ensuring successful integration of these different functions. For example, the solenoid actuator is solely responsible for initiating movement, then the mechanical stability members (spring and/or balls) are the only ones responsible for achieving and maintaining stable positions.

BRIEF SUMMARY

One of the objects of the present disclosure is thus to provide an actuator that still meets the need to achieve bidirectional movement while keeping two stable end-of-stroke positions and using a single unipolar-type power supply, while notably improving the solutions of the prior art, by a solution that is more compact, more integrated and less sensitive to assembly tolerances.

Another object of the present disclosure is to provide, owing to the judicious integration of at least one permanent magnet, an actuator whose functionalities of maintaining a stable position and exiting a stable position are carried out at least in part by the permanent magnet.

In order to respond to these technical problems, the present disclosure relates in its most general sense to an actuator for controlling the movement of a member between two stable positions without current at these stroke ends, with pulsed electrical control without a change in polarity for the passage from one stable position to the other stable position, comprising a ferromagnetic mobile mass, a stator comprising at least one electrically controlled wire coil that is fixed with respect to the mobile mass, at least two ferromagnetic poles that are fixed with respect to the mobile mass and on either side of the mobile mass. The actuator comprises at least one permanent magnet that attracts the mobile mass in order to achieve the two stable positions. The mobile mass defines, with the ferromagnetic poles, at least two variable air gaps during the movement of the mobile mass. The electrical control controls the at least one coil to generate a magnetic flux in a single direction (one way/unidirectional). The mobile mass, the at least one coil, the ferromagnetic poles and the at least one magnet constitute a magnetic circuit, in which the magnetic flux of the permanent magnet opposes the magnetic flux generated by the at least one coil regardless of the position of the mobile mass.

Preferably, the actuator comprises two stops limiting the movement of the mobile mass, the stops being made of a soft ferromagnetic material, channeling the magnetic flux of the magnet and of the coil. The at least two air gaps are preferably arranged symmetrically with respect to the middle of the coil when the mobile mass is centered on its stroke.

Also, the actuator is preferably associated with an electronic circuit generating, for the change of position of the mobile mass from any one of the two stable positions to the opposite stable position, an electrical supply pulse of the coil, with a constant polarity and a duration less than the movement time of the mobile apparatus between its original position and its opposite position.

In a particular embodiment, the actuator comprises two coaxial coils, which are interconnected, and which produce magnetic fluxes in opposite directions.

Preferably, the magnet is secured to the mobile apparatus or the stator.

Advantageously, the actuator further comprises an electronic circuit controlling the duration of the electrical pulse from a table that is a function of the voltage of the power source and/or a table that is a function of the ambient temperature. The duration of the electrical pulse can also be a function of feedback from a position sensor.

The feedback can come, for example, from a back electromotive force measured by a secondary coil or from a reached current level flowing through the supply coil. It can also come from a magnetosensitive sensor detecting the intensity or the direction of the magnetic field emitted by the magnet.

BRIEF DESCRIPTION OF THE DRAWINGS

Other features and advantages of the present disclosure will emerge on the reading of detailed embodiments, with reference to the accompanying figures, which, respectively, show.

DETAILED DESCRIPTION

Figure 1A:
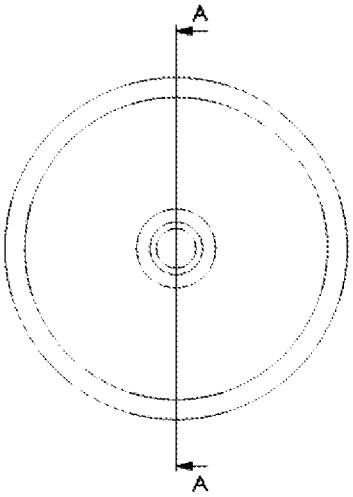
FIGS. 1A and 1B, two views, respectively, from above and in longitudinal section of a device according to a first embodiment of the present disclosure, having a single coil.

An example of a device according to the present disclosure is shown in FIGS. 1A to 1D, the views 1*b* to 1*d* being sectional views along the plane shown in FIG. 1A. In this embodiment, the device is a linear actuator of axisymmetric shape, but without the shape being limiting, a rectangular parallelepiped shape also being possible, for example, as well as a rotary configuration such as that shown in FIG. 6.

Figure 1B:
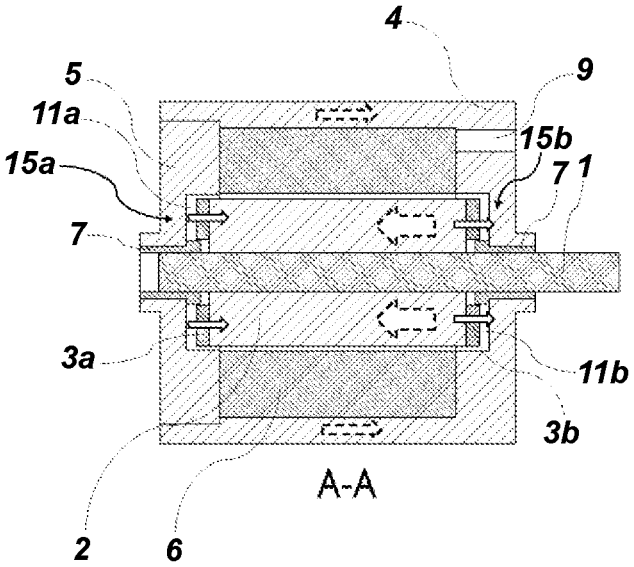
Figure 1C:
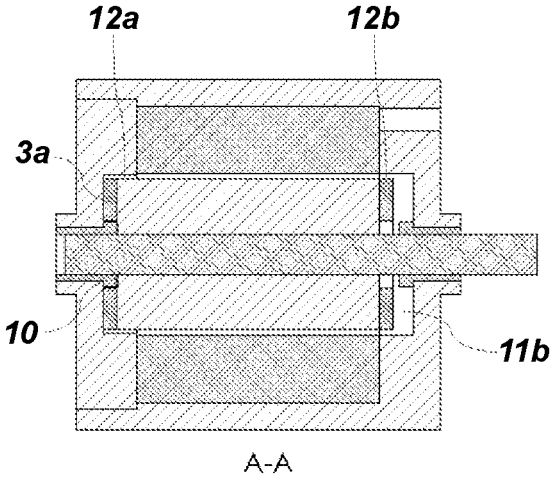
FIGS. 1C and 1D, two longitudinal sectional views of the device of FIG. 1B, in the two stable end positions.
Figure 1D:
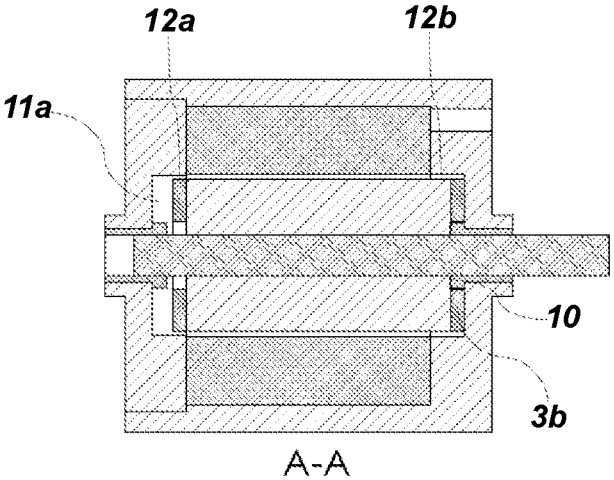

The device described here comprises an axis (1) moving linearly and axially relative to the axisymmetric shape. In the view of FIG. 1B, the axis is secured to a mobile mass (2) on which permanent magnets (3*a*, 3*b*) are positioned axially on either side of the mobile mass (2). The assembly of the axis (1), mobile mass (2) and permanent magnets (3*a*, 3*b*) constitutes an apparatus that is mobile in translation and axially from a first position to a second position or vice versa. The two end positions adopted by this mobile apparatus are shown in FIGS. 1C and 1D. These two positions are so-called stable positions, which is to say, they are held without current owing to the permanent magnets (3*a*, 3*b*) against an external load or acceleration undergone by the device.

The mobile apparatus moves relative to a stator assembly formed by a ferromagnetic sheath (4) and flange (5) as well as by a wire coil (6) made of an electrically conductive material, for example, copper or aluminum. The sheath (4)

and the flange (5) surround the coil (6) in order to channel the magnetic field generated by the coil (6) when the latter is supplied with current and at least in part the magnetic field generated by the magnets (3*a*, 3*b*). The mobile apparatus therefore moves relative to the stator assembly by sliding on two bearings (7), on either side of the mobile mass (2). The stator assembly forms two ferromagnetic poles (15*a*, 15*b*) on either side of the mobile mass (2), then forming two axial air gaps (11*a*, 11*b*) and two radial air gaps (12*a*, 12*b*). Preferably, the actuator has a symmetry such that, in the central position of the mobile mass (2) on its stroke, the air gaps (11*a*, 12*a*) on the one hand and (11*b*, 12*b*) on the other hand are identical.

Preferably, the bearings (7) and the axis (1) are made of non-magnetic material, but it can also be envisaged to produce these elements in ferromagnetic material if there is a need to locally modify the laws of force of the actuator or for reasons of mechanical strength of the material. In order to minimize the mechanical impacts at the magnets, it is proposed here, but in a nonlimiting manner, to produce the mechanical stop by contact of the mobile mass (2) on the bearings (7), at contact zones (10), shown in FIGS. 1C and 1D, between these two elements. The opening (9) is optional and here proposed to exit the feed wires from the coil (6) longitudinally. The latter can just as well come out radially from the sheath (4).

In FIG. 1B, the dotted arrows show the direction of circulation of the magnetic flux generated by the coil (6) when the latter is supplied, while the solid arrows show the direction of orientation of the magnetic flux generated by the magnets (3*a*, 3*b*). In all the embodiments of devices according to the present disclosure, it is essential that the circulation directions of the magnetic fluxes generated by the magnets are opposite that generated by the coil (6), whatever the position of the mobile apparatus. It is therefore important for the present disclosure to give and choose a single direction of winding and of supplying voltage or current to the coil (6) in accordance with this magnetic flux circulation. In this first embodiment, the flux of the permanent magnets (3*a*, 3*b*) is additive, i.e., the direction of the arrows is in the same direction axially so that the flux of magnets (3*a*, 3*b*) is opposed to that of the coil (6).

Indeed, and this is one of the objects of the present disclosure, whether the mobile apparatus is in the first stable position—FIG. 1C—or in the second stable position—FIG. 1D—the flux of the coil (6) is such that it always opposes the flux of the magnets (3*a*, 3*b*). In this way, a force is generated, which is added to that created by the variable reluctance due to the coil, resulting from the mutual action of the fluxes of the coil (6) and magnets (3*a*, 3*b*) and proportional to the remanence of the magnets (3*a*, 3*b*) and the current in the coil (6), such that a pull-off strength from the stable position tends to bring the mobile apparatus to the middle position. As a result, this proportional force, like the variable reluctance force, is canceled out in the middle of the stroke.

In the text, the term "opposite flux between magnet and coil" is understood to mean that, whatever the position of the mobile mass (2), the flux of the magnet (3*a*, 3*b*) circulating through the coil (6)—which is to say, the one at the origin of the proportional force—is opposed to the flux of the coil when the latter is supplied.

In FIG. 1C, showing the first stable position without current assumed by the mobile mass (2), the axial air gap (11*a*) is minimized, zero or reduced to a thin air knife, while the axial air gap (11*b*) is maximized. In these two air gaps, when a current passes through the coil (6), the magnetic flux generated by the magnets (3*a*, 3*b*) opposes the magnetic flux generated by the coil (6). By an imbalance of air gaps and reluctances, the mobile mass (2) is driven from its stable position.

In FIG. 1D, showing the second stable position without current assumed by the mobile mass (2), the axial air gap (11*a*) is maximized, while the axial air gap (11*b*) is minimized, zero or reduced to a thin air knife. In these two air gaps, when a current passes through the coil (6), the magnetic flux generated by the magnets (3*a*, 3*b*) opposes the magnetic flux generated by the coil (6). By an imbalance of air gaps and reluctances, the mobile mass (2) is driven from its stable position.

Another object of the present disclosure is to add the force proportional to the force generated by the sole action of the coil (6) by variable reluctance between the mobile mass (2), the sheath (4) and the flange (5). The sizing of these elements is preferably done such that, when the mobile apparatus is in a central position, or in the middle of the stroke as shown in FIG. 1B, the axial (11*a*, 11*b*) and radial (12*a*, 12*b*) air gaps between the mobile mass (2) on the one hand and the sheath (4) and the flange (5) on the other hand are identical on either side of the mobile mass (2). It is also specified that the use of a sheath (4) and of a flange (5), in particular, is not absolutely necessary, as long as the channeling of the magnetic fluxes is carried out by a ferromagnetic case, whatever it may be. It is also specified that an asymmetry of the various air gaps in the central position is possible if it is desired to give the actuator an asymmetrical behavior.

Through the use of permanent magnets to achieve the stable position functions as well as the output force of the stable positions—or pull-off strength—a device according to the present disclosure provides notable improvements in terms of size, ease of assembly and efficiency of the actuator.

FIGS. 2A to 2D are examples of alternative embodiments, similar to the device shown in FIG. 1B with regard to the mobile mass (2), the coil (6), the axis (1) and the bearings (7), but which differ in terms of the position of the permanent magnets (3*a*, 3*b*).

Figure 2A:
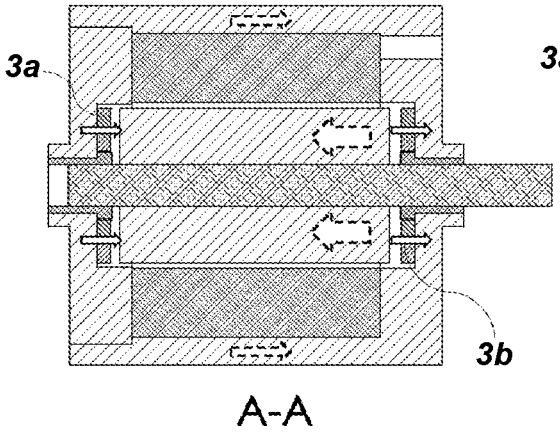
FIGS. 2A to 2D, longitudinal sectional views of alternative embodiments to the device of FIGS. 1A-1D.

In FIG. 2A, the permanent magnets (3*a*, 3*b*) are positioned on the stator assembly and not on the mobile apparatus, secured to the flange (5) on the one hand and to the sheath (4) on the other hand.

Figure 2B:
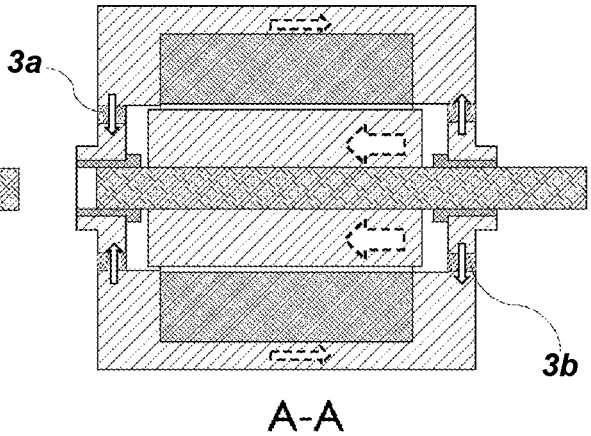

In FIG. 2B, the permanent magnets (3*a*, 3*b*) are positioned, integrated into the flange (5) and the sheath (4) in the form, for example, of annular magnets preferably magnetized radially. In order to comply with the present disclosure in this single coil embodiment, the permanent magnets (3*a*, 3*b*) must be magnetized so that the magnetic fluxes are additive, which is to say, owing to an internal radial magnetization for one magnet (3*a*) and an external radial magnetization for the other magnet (3*b*). The flux of the magnets (3*a*, 3*b*) thus always opposes the flux of the coil (6). In this figure, no flange is shown; the sheath (4) produces all the ferromagnetic parts of the stator in one piece. In addition, there is no axial opening for the exit of the wires, which can be done, for example, radially (not shown here).

Figure 2C:
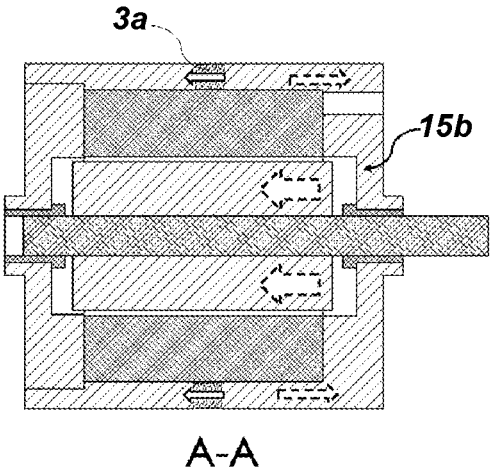

In FIG. 2C, the magnets (3*a*, 3*b*) are positioned on the outside of the actuator at the sheath (4), for example, in the form of angular sectors or in the form of a ring between two parts of the sheath (4). This embodiment makes it possible, in particular, to use a larger volume of magnet and therefore potentially greater forces. The direction of the magnetic flux generated by the magnets (3*a*, 3*b*) is still opposite that of the flux generated by the coil (6) when the latter is supplied.

Figure 2D:
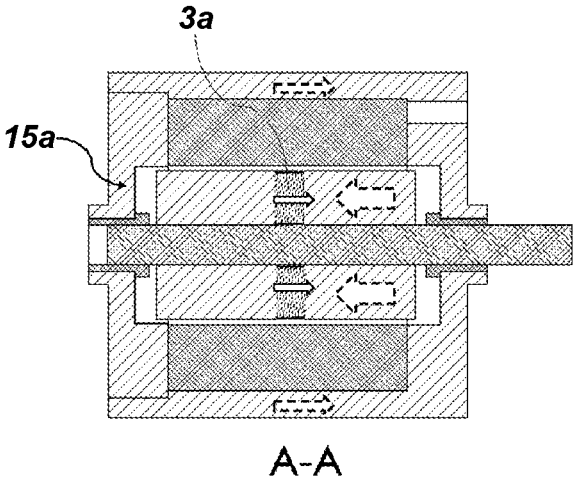

In FIG. 2D, the permanent magnets are in the form of a single ring magnet (3*a*), that is magnetized axially and positioned inside the mobile mass (2), for example, as a layer of material interposed between two half-parts of the mobile mass (2) and always in such a way that its magnetic flux opposes that of the coil (6) when the latter is supplied.

It is specified that these alternative embodiments of the first embodiment are not limiting and are given by way of examples.

Detailed Description of a Secondary Embodiment

Figure 3:
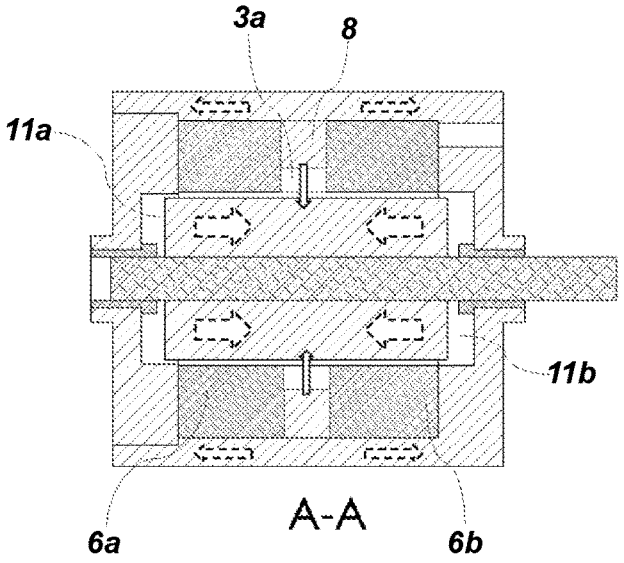
FIG. 3, a longitudinal sectional view of another embodiment of the present disclosure, showing two coils.

FIG. 3 shows an alternative embodiment comprising two coaxial coils (6*a*, 6*b*) that are connected to one another in series or in parallel in order to obtain only two supply wires. These coils (6*a*, 6*b*) are positioned inside the magnetic sheath (4) on either side of a ferromagnetic pole piece (8). The winding direction of the coils (6*a*, 6*b*) is alternated between each coil so that the magnetic fluxes generated by the two coils (6*a*, 6*b*) are opposite each other, in order to generate mainly a magnetic field circulation direction of the coils (6*a*, 6*b*) as indicated by the dotted arrows. The direction of circulation can be opposite if the direction of magnetization of the magnet (3*a*) is also opposite.

In this embodiment, the pole piece (8) is in fact extended radially and internally by a magnet (3*a*), for example, in the form of a ring whose magnetization is always such that the generated flux opposes the flux of the coils (6*a*, 6*b*), for example, radial outgoing or re-entering. It is specified that the ring can be replaced by an assembly of tiles or prisms, the magnetization of which is locally unidirectional in order to form, overall, a re-entering or exiting magnetization.

Operating Principle of a Device According to the Present Disclosure

Figure 4:
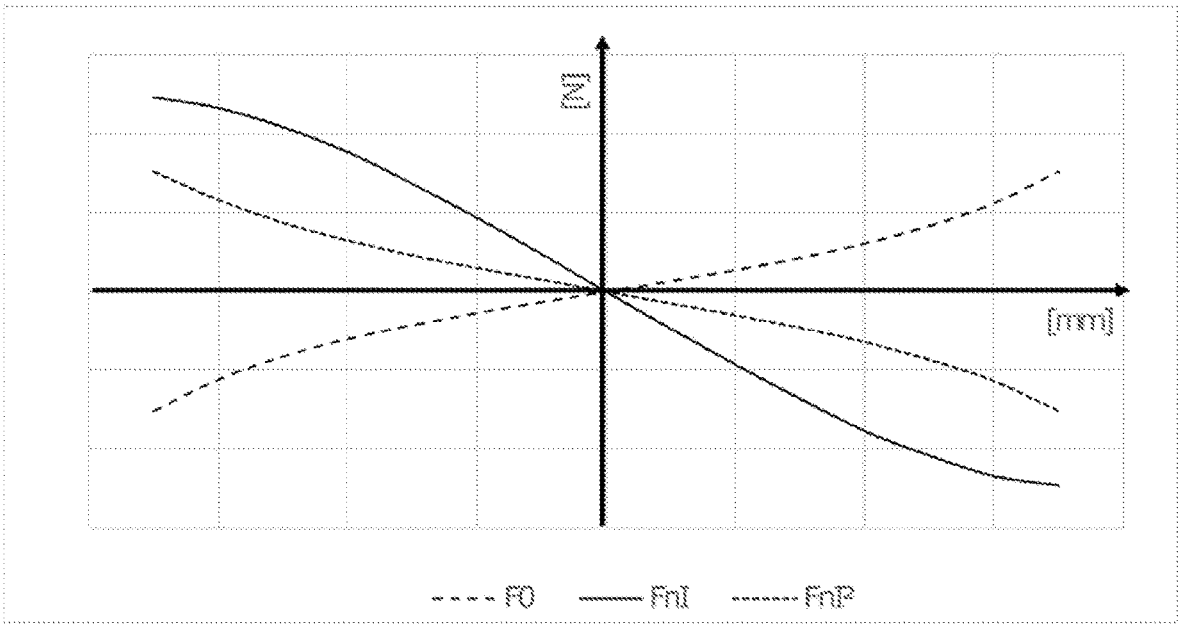
FIG. 4, a graph showing the typical evolution of the different components of the force generated by a device according to the present disclosure.

FIG. 4 shows the typical force curves—in Newtons ([N])—generated by an actuator according to the present disclosure, as a function of the position of the mobile mass (2)—in millimeters ([mm])—without the shapes and the amplitudes being limiting. Without current in the coil (6), the force (F0) applied to the mobile mass (2) is negative on the left of the graph and positive on the right of the graph, denoting the two stable positions without current. With current, if the forces applied to the mobile mass (2) are broken down, a first component (Fn1) is found that corresponds to the proportional action of the magnets (3*a*, 3*b*) and of the current injected into the coil (6), and a second component (Fn12) is found that corresponds to the action of the variable reluctance between the sheath (4), the flange (5) and the mobile mass (2) under the action of the current alone. These last two curves have a similar evolution, and therefore the joint action gives a positive force on the left of the graph and a negative force on the right of the graph, denoting the increased ability to move out of stable positions in order to move the mobile apparatus toward the middle of the stroke where the forces decrease to cancel each other out.

It is thus essential, in the present disclosure, to associate the actuator with electronics for controlling the voltage or the current injected into the coil (6) that are synchronized with the movement of the mobile mass (2). Ideally, the stopping of the supply to the coil can be controlled, in a closed loop, by the position detection carried out by a sensor (not shown) that is external or integrated into the actuator, as described below. The supply can also be stopped in an open loop owing, for example, to a table with several dimensions taking into account fluctuations in the supply voltage and external conditions, such as load or temperature.

Figure 5:
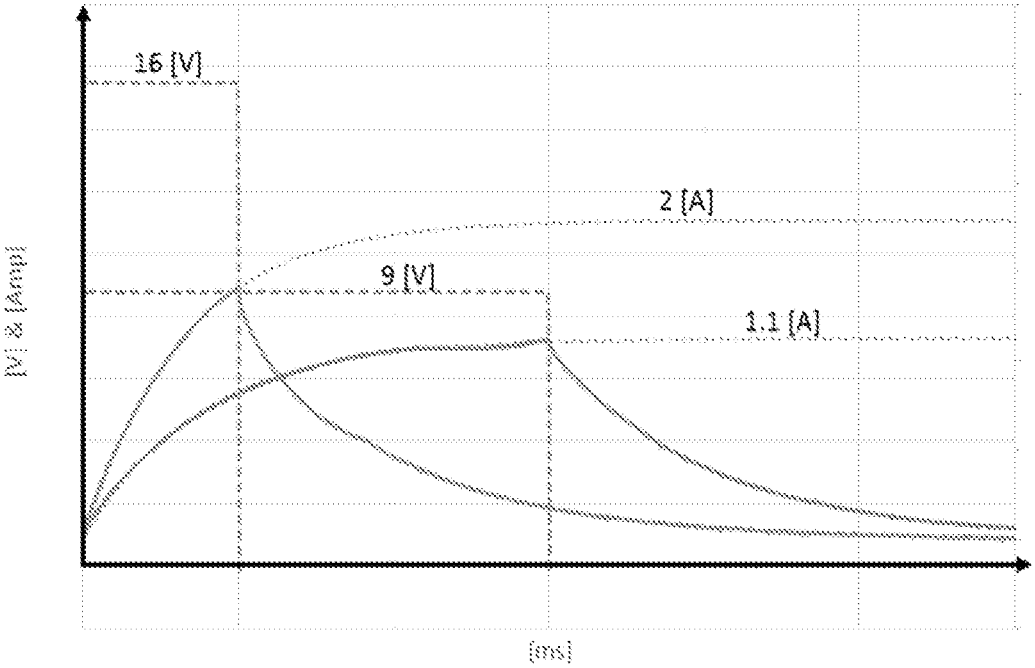
FIG. 5, a graph showing the typical change of the control voltages and the corresponding currents applied to a device according to the present disclosure.

By way of example, FIG. 5 shows that for two different control voltage levels—in Volts ([V])—the supply duration—in milliseconds ([ms])—of the coil (6) is variable. For 9 volts, this duration is greater than that necessary for a control voltage of 16 volts. Consequently, the forms of current—in Amperes ([A])—are different, although ultimately involving a similar mechanical energy, if not strictly equal given the non-homogeneous conditions between the two cases (speed, peak current level, etc.).

In the case of the closed-loop use of position information or of reaching a current threshold, a device according to the present disclosure can advantageously integrate a function for detecting the current threshold or the induced voltage owing to the coils (6*a*, 6*b*) themselves or to one or more other detection coils adjacent to the coils (6*a*, 6*b*) and that are not supplied with voltage. For example, position detection can be carried out when a voltage threshold induced in these detection coils is reached. Detection can also be carried out by reaching a given value of current in the control coil (6*a*, 6*b*).

Figure 7A:
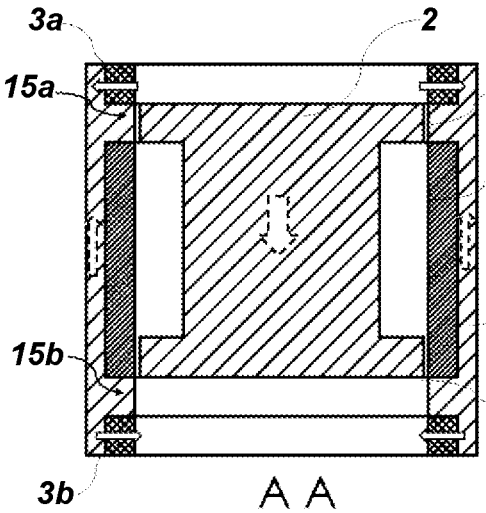
FIGS. 7A, 7B, two longitudinal sectional views of two other embodiments of a device according to the present disclosure having a linear stroke.
Figure 7B:
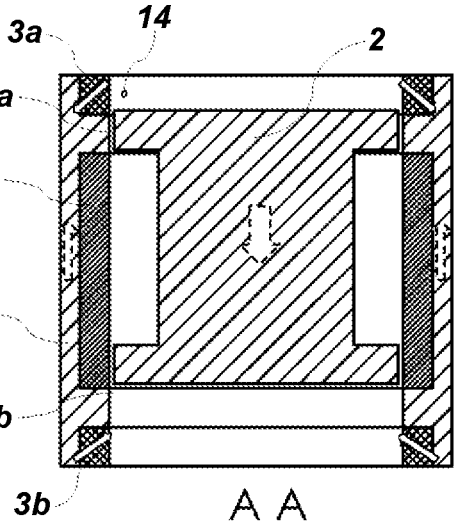
Figure 8:
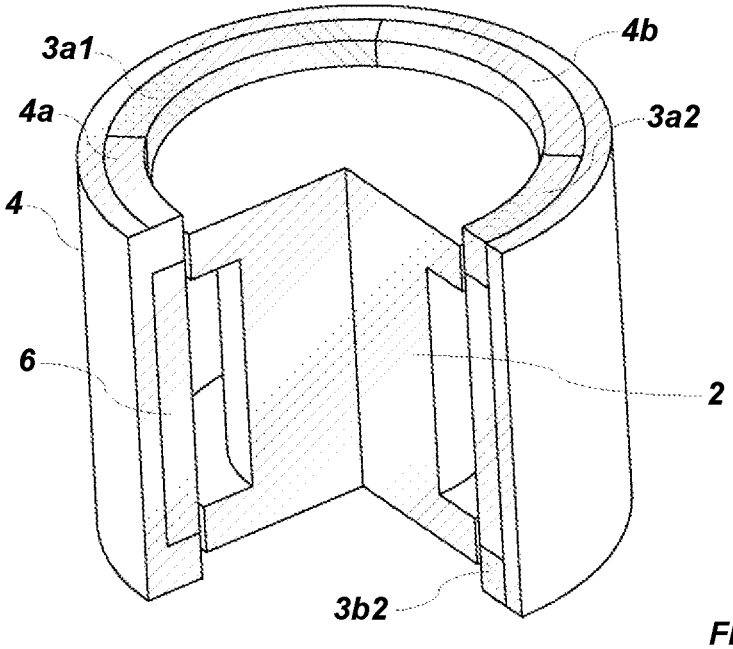
FIG. 8, a perspective view in partial section of another embodiment of a device according to the present disclosure having a linear stroke.

FIGS. 7A, 7B and 8 are other embodiments of linear actuators. FIGS. 7A and 7B refer to two similar embodiments that are differentiated by the orientation of the magnetization of the magnets (3*a*, 3*b*). In FIG. 7A, the magnetization is radial outgoing or re-entering, while it has an angular orientation with respect to the movement axis in FIG. 7B. This angle here is close to 45°, but this value is not limiting and serves, in particular, to increase the force due to the magnets in order to maximize the stability force on both sides of the stroke. The stator structure differs from the previous ones in that it consists of a single sheath (4) without flange, and in that it only has radial air gaps (12*a*, 12*b*) without axial air gaps. The ferromagnetic poles (15*a*, 15*b*) formed by the sheath (4), single and without flange here, form these air gaps (12*a*, 12*b*) and serve to receive, on their axial extension, the magnets (3*a*, 3*b*). The orientation of the magnetization of the magnets (3*a*, 3*b*) is always such that the magnetic flux generated by the magnets (3*a*, 3*b*) is always opposed to that of the coil (6) regardless of the position of the mobile mass (2).

FIG. 7B also shows a magnetosensitive sensor (14), for example, with a Hall effect, detecting the magnetic induction at a given point, the position of which can be adjusted to optimize the signal, and the intensity or the direction of which is scalable according to the position of the mobile mass (2). It is specified that such a sensor can be used in any other configuration presented in this document.

FIG. 8 shows an even more compact embodiment using only magnet sectors (3*a*1, 3*a*2, 3*b*2) instead of the ring magnet. The magnet sectors (3*a*1, 3*a*2, 3*b*2) are thus embedded in the sheath (4) between poles (4*a*, 4*b*) of the sheath (4).

All of the presented examples refer to a linear actuator, but it is specified that the present disclosure can be considered entirely for a rotary or curvilinear actuator by applying the teachings presented above.

Figure 6:
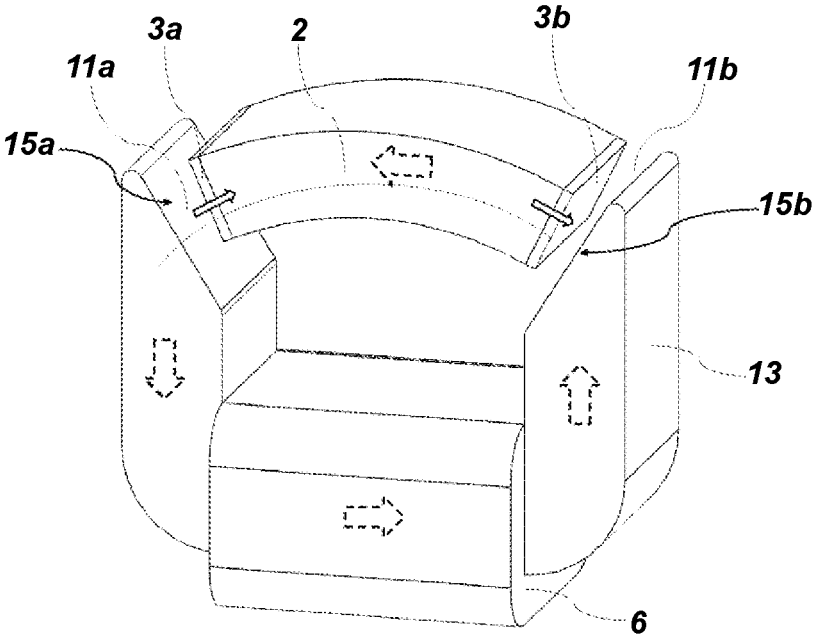
FIG. 6, a perspective view of an embodiment of a device according to the present disclosure having a rotary stroke.

By way of example, FIG. 6 shows such a rotary actuator, the dotted line denoting the path followed by the mobile mass (2), here secured to the magnets (3*a*, 3*b*). The elements and functions identical to those described above for linear cases are found, the biggest difference here being the stator (13) made from ferromagnetic material that replaces the sheath (4) and the flange (5), but keeping the same mechanical and magnetic function of ensuring, directly or indirectly via a bearing, the stops and the channeling of magnetic fluxes.

Figure 9:
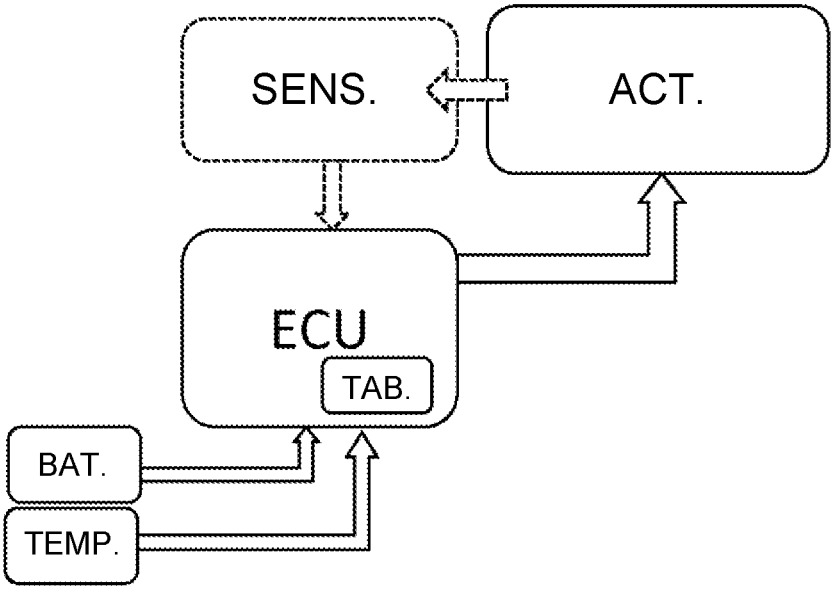
FIG. 9, a schematic view of the control architecture of an actuator according to the present disclosure.

FIG. 9 schematically shows the control architecture that can be used to control an actuator according to the present disclosure. This architecture here comprises the actuator (ACT.) with which a position sensor (SENS.) is possibly associated that sends its signal to an electronic control circuit (ECU). In order to best calibrate the pulse duration sent to the actuator (ACT.), the electronic circuit (ECU) comprises a table (TAB.) that calculates this pulse duration from the battery supply voltage (BAT.) and ambient temperature (TEMP.) information.

Figures 10A, 10B, 10C:
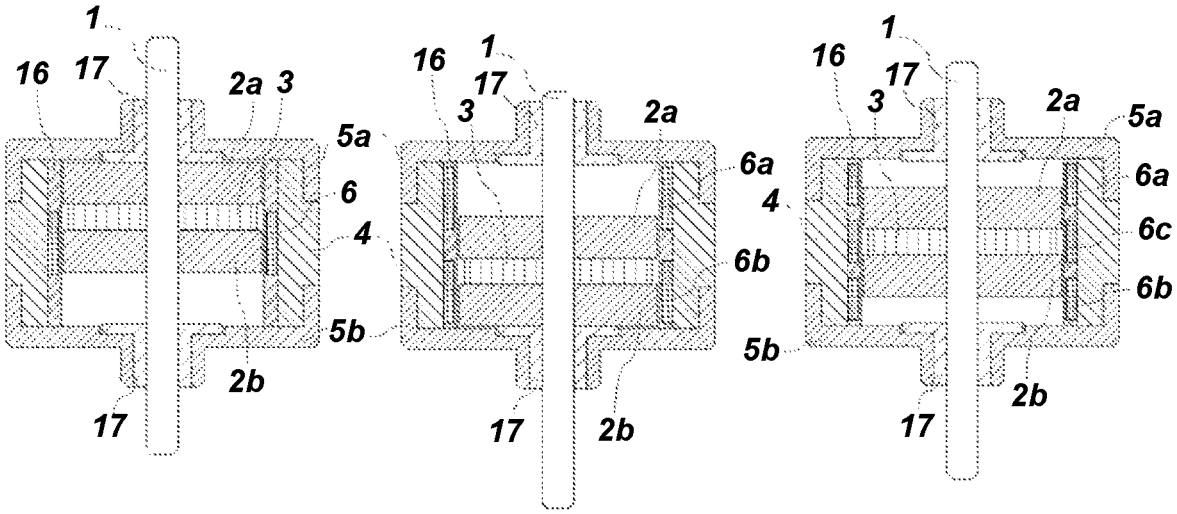
FIGS. 10A, 10B, and 10C, three sectional views of three alternative embodiments of an actuator according to the present disclosure.

FIGS. 10A, 10B and 10C show three sectional views of three alternative embodiments of an actuator according to the present disclosure. The choice of using one or the other actuator among these examples of FIGS. 10A, 10B, 10C will be dictated by the compromise between production cost and desired performance.

The actuators shown in FIGS. 10A, 10B and 10C have common elements, with, in particular, an axis (1) secured to two mobile masses (2*a*, 2*b*) between which a permanent magnet (3) is positioned, guided and sliding inside two bearings (17). This mobile apparatus moves between two stable end-of-stroke positions delimited by two upper and lower flanges (5*a*, 5*b*), respectively, secured by a sheath (4). The mobile masses (2*a*, 2*b*), the flanges (5*a*, 5*b*) and the sheath (4) are made of a soft ferromagnetic material in order to channel the magnetic field of the magnet (3) and of the coil(s) (6, 6*a*, 6*b*, 6*c*), the number of which differs according to the variants shown in these three figures. The stroke ends are materialized either by contact of the mobile masses (2*a*, 2*b*) with, respectively, the flanges (5*a*, 5*b*) or by contact of the mobile masses (2*a*, 2*b*) with the guide bearings (17).

In FIG. 10A, there is only one coil (6) fixed to a coil body (16) and positioned in the vicinity of the transverse median plane of the actuator so that it is radially opposite the mobile masses (2*a*, 2*b*) in one or the other of the end-of-stroke positions. For example, FIG. 10A shows a "high" end-of-stroke position and the mobile mass (2*b*) is radially opposite the coil (6).

In FIG. 10B, there are two coils (6*a*, 6*b*) fixed on a coil body (16) and positioned on either side of the transverse median plane of the actuator so that they are radially facing the mobile masses (2*a*, 2*b*) in one or the other of the end-of-stroke positions. For example, FIG. 10B shows a "bottom" end-of-stroke position and the mobile mass (2*b*) is radially opposite the bottom coil (6*b*).

In FIG. 10C there are three coils (6*a*, 6*b*, 6*c*) fixed on a coil body (16) and positioned in the vicinity of the transverse median plane of the actuator for the coil (6*c*) and on either side of the median plane for the coils (6*a*, 6*b*) so that they are radially facing the mobile masses (2*a*, 2*b*) in one or the other of the end-of-stroke positions. For example, FIG. 10C shows a mid-stroke position. The reader will understand that in the "high" end-of-stroke position, the coils (6*a*, 6*c*) will be facing the mobile masses, respectively (2*a*, 2*b*), and that in the "low" end-of-stroke position, the coils (6*c*, 6*b*) will be opposite the mobile masses, respectively (2*a*, 2*b*).

The invention claimed is:

1. An actuator for controlling the movement of a ferromagnetic mobile mass between two stable positions, comprising:

the ferromagnetic mobile mass;

a stator comprising at least one wire coil fixed with respect to the mobile mass;

at least two ferromagnetic poles fixed with respect to the mobile mass on either side of the mobile mass;

at least one permanent magnet located and configured to attract the mobile mass to each of the two stable positions; and an electronic control circuit configured to deliver pulsed electric current to the wire coil to control movement of the mobile mass from each stable position to the other stable position of the two stable positions;

wherein the mobile mass defines, with the ferromagnetic poles, at least two variable air gaps during the movement of the mobile mass;

wherein the electronic control circuit is configured to operate with no change in polarity to generate a magnetic flux in a single direction in the wire coil; and wherein the mobile mass, the at least one wire coil, the ferromagnetic poles and the at least one magnet constitute a magnetic circuit in which magnetic flux of the permanent magnet opposes the magnetic flux generated by the at least one wire coil regardless of a position of the mobile mass.

2. The actuator of claim 1, further comprising two stops limiting movement of the mobile mass, the stops comprising a soft ferromagnetic material for channeling the magnetic flux of the magnet and of the coil.

3. The actuator of claim 1, wherein the electronic control circuit is configured to generate, for the change of position of the mobile mass from any one of the two stable positions to the opposite stable position, a current pulse to the wire coil, with a constant polarity and a duration less than a movement time of the mobile mass between the one of the two stable positions to the opposite stable position.

4. The actuator of claim 1, wherein the at least two air gaps are arranged symmetrically with respect to the middle of the wire coil when the mobile mass is centered on the stroke between the two stable positions.

5. The actuator of claim 1, further comprising two interconnected coaxial coils, the interconnected coaxial coils configured to produce magnetic fluxes in opposite directions.

6. The actuator of claim 1, wherein the at least one permanent magnet is secured to the mobile mass or the stator.

7. The actuator of claim 1, wherein the electronic control circuit is configured to control a duration of the electrical pulse from a table that is a function of a voltage of a power source.

8. The actuator of claim 1, wherein the electronic control circuit is configured to control a duration of the electrical pulse from a table that is a function of an ambient temperature.

9. The actuator of claim 1, wherein the electronic control circuit is configured to control a duration of the electrical pulse as a function of feedback from a position sensor.

10. The actuator of claim 9, wherein the feedback relates to a back electromotive force measured by a secondary coil or from a current level flowing through the at least one wire coil.

11. The actuator of claim 9, wherein the feedback is provided from a magnetosensitive sensor detecting an intensity or a direction of a magnetic field emitted by the at least one permanent magnet.

* * * * *